United States Patent [19]

Lopez et al.

[11] 4,292,880

[45] Oct. 6, 1981

[54] QUADRANT ELEVATION CONTROL DEVICE

[75] Inventors: Bennie F. Lopez; Billy H. Campbell; Bobby D. Collier; William J. Laird; Edward J. Debona; James E. Eubanks, Jr., all of Huntsville, Ala.

[73] Assignee: The United States of America as represented by the Secretary of the Army, Washington, D.C.

[21] Appl. No.: 72,507

[22] Filed: Sep. 4, 1979

[51] Int. Cl.[3] ..... F41F 3/04

[52] U.S. Cl. ..... 89/1.815; 89/41 M; 200/61.47; 200/61.52; 318/648

[58] Field of Search ..... 89/1.802, 1.815, 41 R, 89/41 M, 41 MG, 41 H; 200/61.47, 61.52; 318/648, 649

[56] References Cited

U.S. PATENT DOCUMENTS

| | | | |
|---|---|---|---|
| 1,391,782 | 9/1921 | McDannold | 200/61.52 |
| 2,515,051 | 7/1950 | Lloyd | 89/1.815 |
| 3,204,233 | 8/1965 | Olliff | 200/61.47 |

FOREIGN PATENT DOCUMENTS

| | | | |
|---|---|---|---|
| 829194 | 3/1960 | United Kingdom | 89/1.815 |

*Primary Examiner*—Stephen C. Bentley

*Attorney, Agent, or Firm*—Nathan Edelberg; Robert P. Gibson; James T. Deaton

[57] ABSTRACT

A quadrant elevation control device that has an adjustable means for allowing predetermined launch angles to be selected and after selection to be used to control the elevation of a launcher to the predetermined angle and interrupt elevation of the launcher when the predetermined angle is reached.

3 Claims, 5 Drawing Figures

QUADRANT ELEVATION CONTROL DEVICE

DEDICATORY CLAUSE

The invention described herein may be manufactured, used, and licensed by or for the Government for governmental purposes without the payment to us of any royalties thereon.

BACKGROUND OF THE INVENTION

The development of a launcher that has the capability of firing a multiplicity of rockets has established a need for a simple device that can be adjusted easily to allow the launcher to be adjusted to predetermined angles from the horizon relative to gravity.

Therefore, it is an object of this invention to provide a quadrant elevation control device that enables one to make a single adjustment to a predetermined angle and thereby allow the launcher to be elevated to the predetermined angle relative to horizon and gravity even though the launcher and track vehicle are not in a level position.

Another object of this invention is to provide a quadrant elevation control device that is simple and requires a minimum amount of adjustment to accomplish elevating the launcher as described.

Other objects and advantages of this invention will be obvious to those skilled in this art.

SUMMARY OF THE INVENTION

In accordance with this invention, a track vehicle has a launcher thereon that has a multiplicity of launch tubes therein and the launcher is pivotally secured for being elevated at predetermined angles for firing of missiles from the launcher. The angle at which it is desired to fire the missiles is predetermined and then a quadrant elevation control device is used for controlling elevation of the launcher to this predetermined angle. The quadrant elevation control device is secured to one side of the launcher and includes an inclosure that has a cylindrical rod pivotally mounted and longitudinally moveable relative to the inclosure and on the rod a gunner's quadrant is secured. The gunner's quadrant includes a structural support member that has a generally triangular section that is disposed for having a pivotable arm secured at one end to an apex of the triangular section and an opposite end that has an index for pivoting the arm relative to the quadrant from 0° to about 60°. This arm has a level vial mounted thereon which is in the level position at 0° when the launcher and track vehicle are in a level position. A second level vial is mounted on the housing structure perpendicular to the level vial of the arm. A mercury switch is mounted on the arm and is calibrated to the level vial on the pivotable arm of the gunner's quadrant. The mercury switch is calibrated so that when the launcher is elevated to an angle that the pivotable arm is set for the launcher to be elevated to, the mercury switch will interrupt an electrical circuit and cause the elevation mechanism for the launcher to be interrupted.

DESCRIPTION OF THE PREFERRED EMBODIMENT

Figure 1:
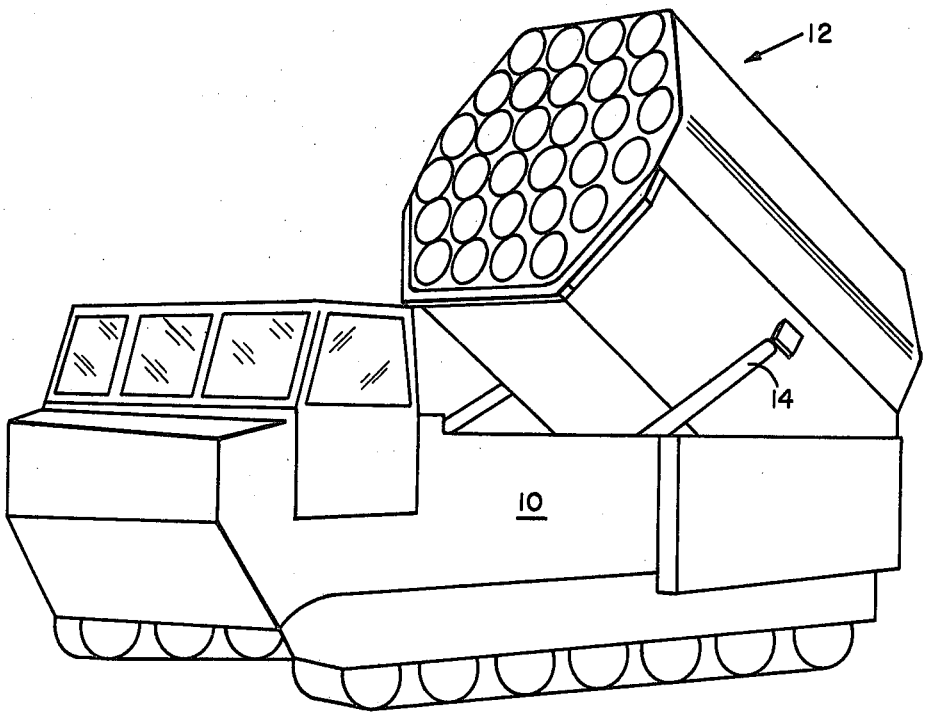
FIG. 1 is a perspective view of a track vehicle with a launcher thereon in accordance with this invention.
Figure 2:
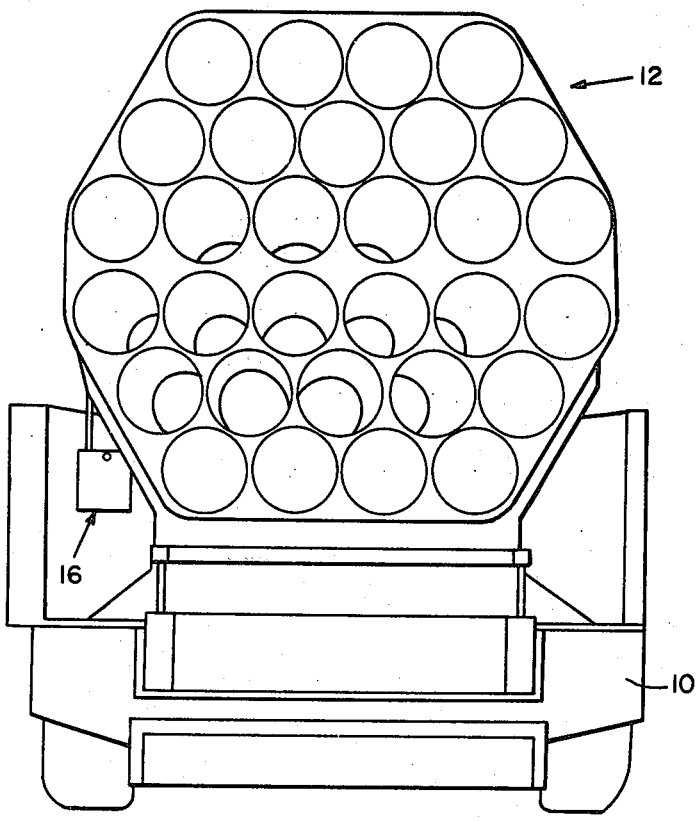
FIG. 2 is a rear end view of the track vehicle, launcher and the quadrant elevation control device in accordance with this invention.
Figure 3:
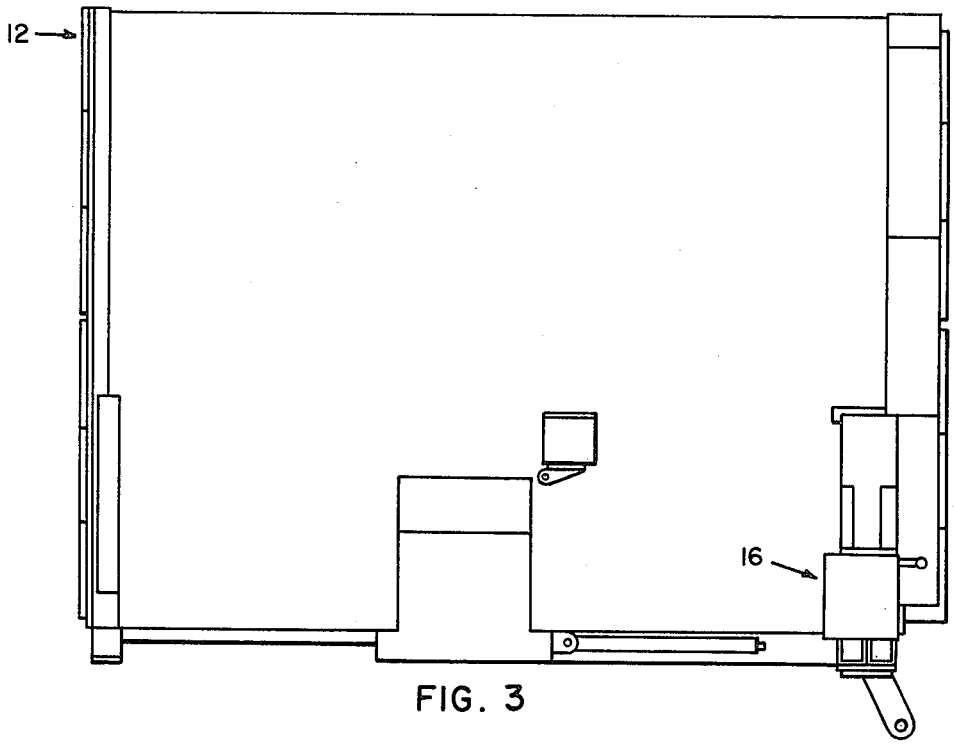
FIG. 3 is a side view of a launcher illustrating the quadrant elevation control device mounted on the side thereof.
Figure 4:
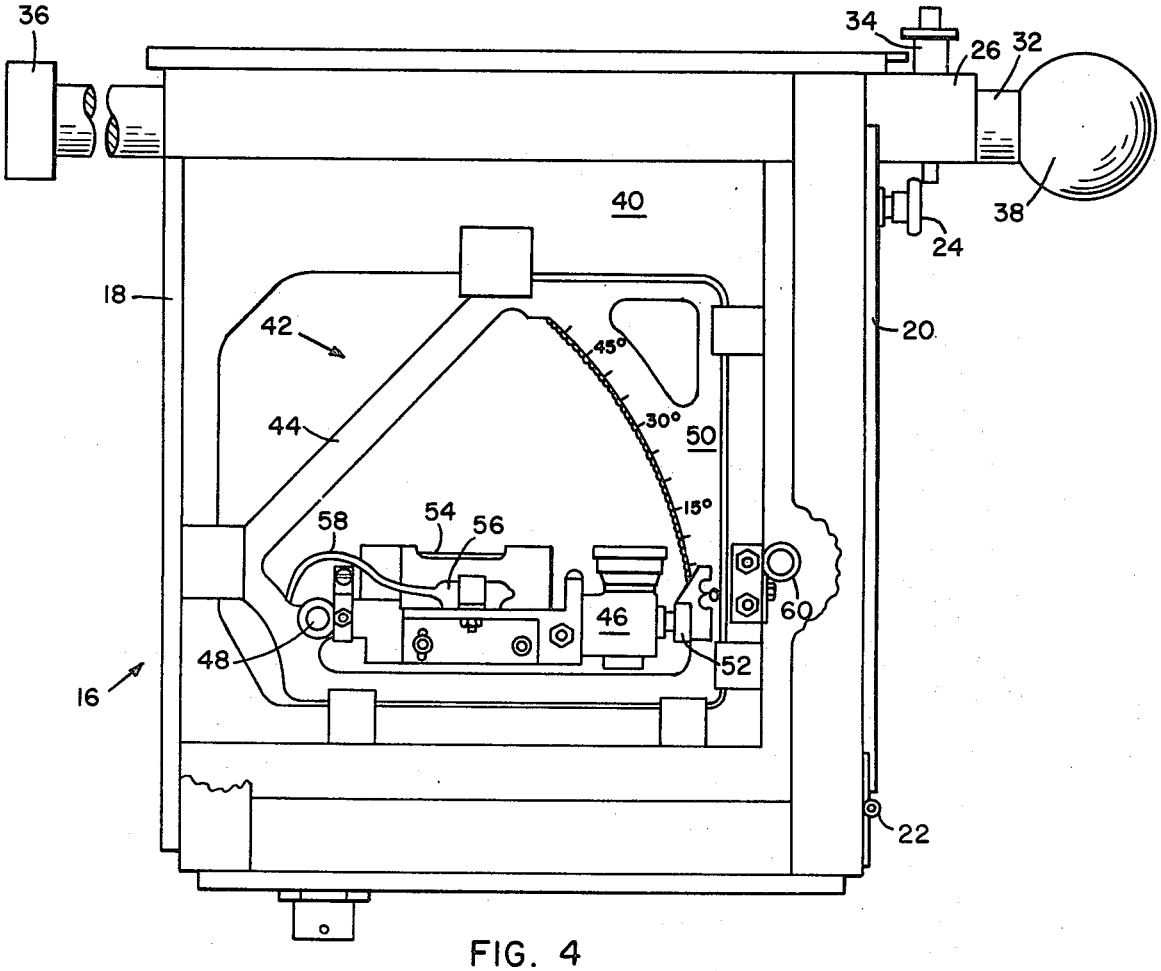
FIG. 4 is a side view of the elevation control device with one side removed to see the parts inside.
Figure 5:
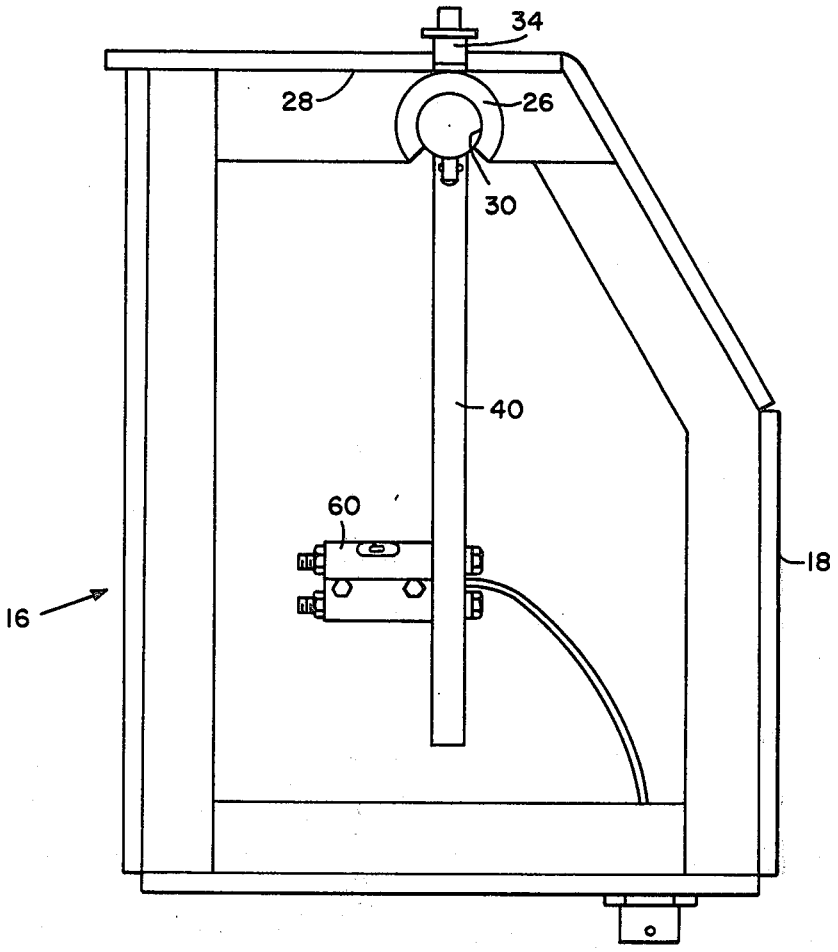
FIG. 5 is an end view illustrating parts of the quadrant elevation control device with the door and hinge removed.

Referring now to the drawing, a track vehicle 10 is illustrated in FIGS. 1 and 2 and has a rocket launcher 12 mounted thereon. Rocket launcher 12 is moved to an elevated position as illustrated in FIG. 1 by conventional electric motor means (not shown) and by gear means 14. Launcher 12 has quadrant elevation control device 16 mounted on the side thereof as illustrated in FIGS. 2 and 3. Quadrant elevation control device 16 includes a housing 18 that has sides, tops and ends one end of which is a door 20 (see FIG. 4) for closing the housing structure. Door 20 is hinged at 22 and has a latch 24 for holding door 20 closed. Housing 18 is secured to the side of launcher 12 in any conventional manner so that it remains stationary once it is secured in the desired predetermined relationship to the launcher. At top surface 28 of housing 18 a cylindrical member 26 except for an arcuate portion being removed at the bottom thereof is securely fastened in a conventional manner to fix member 26 relative to the top of housing 18. Member 26 has a cylindrical opening 30 therethrough in which cylindrical rod 32 is pivotably and slidably mounted. A pin 34 is positioned through openings in member 26 and rod 32 to secure rod 32 in a predetermined inward position. A sleeve 36 (see FIG. 4) is secured in a conventional manner to a rear end of rod 32 for limiting axial movement thereof. An actuating knob 38 is securing at the other end of rod 32 for actuating and moving rod 32 both upon pivoting as well as linear movement. A mounting structure 40 is integrally secured to rod 32 in a conventional manner and mounts gunner's quadrant 42 in a conventional manner using conventional securing means. Gunner's quadrant 42 includes a triangular shaped body 44 that has a base portion to which pivotable arm 46 is pivotably connected at 48 with indicia on arcuate surface 50 for indicating the number of degrees from about 0° to 50° and an index pointer 52 for adjustment relative to the surface of member 50 to adjust to the number of degrees desired. Pivotable arm 46 has a gunner's quadrant level vial 54 mounted thereon which indicates when arm 46 is in a level position and at 0° when the track vehicle and launcher are in a level position. A mercury switch 56 is also secured to arm 46 in a conventional manner so that when the bubble in level vial 54 is actuated through and just as the launcher is elevated past a level position the mercury in mercury switch 56 will disconnect leads 58 connected thereto and interrupt a circuit to an electric motor (not shown) which has actuated launcher 12 through gear means 14 to elevate the launcher to the desired angle for firing rockets from the launcher. A second level vial 60 is mounted on support structure 40 and level vial 60 is mounted so as to be perpendicular to level vial 54. With this structure, and with housing 18 properly secured in position to launcher 12, with launcher 12 and track vehicle 10 in a level position, the bubbles in level vials 54 and 60 are calibrated to the level position with index 52 set at 0° and with support structure 40 being positioned completely vertical to gravity.

In operation, when it is desired to elevate launcher 12 for the firing of rockets from the various tubes thereof, knob 38 is actuated with door 20 pivoted open so as to allow knob 38 to be grasped and move rod 32 linearly of member 26 with pin 34 removed. This allows the gunner's quadrant and pivotable member to be moved out into the open to where index pointer 52 of the gunner's quadrant can be adjusted to the number of degrees desired for elevating launcher 12. With this device, and with the index set to the desired number of degrees, even though the launcher and track vehicle may not be in a level position, by adjusting support structure 40, by turning knob 38 until the bubble in vial 60 is in a level position relative to gravity, launcher 12 can be elevated to the desired number of degrees from the horizon by merely turning on the motor (not shown) which drives through gear arrangement 14 to elevate launcher 12 until the predetermined angle selected by pivotable arm 46 has been attained. When the predetermined number of degrees have been attained by launcher 12 relative to the horizon, the bubble in vial 54 will be actuated to the level position and then toward an unlevel position. As the bubble in vial 54 moves through and just past the level position, the mercury in mercury switch 56 will move to disrupt the circuit through leads 58 to cut off the motor which is actuating launcher 12 and thereby cause launcher 12 to stop at the selected predetermined angle relative to the horizon. The launcher is maintained in the predetermined elevated position by conventional locking means. As can be seen, by providing the simple quadrant elevation control device one can make simple adjustments of arm 46 and level vial 60 and cause launcher 12 to be elevated to a predetermined angle relative to the horizon even though the launcher and track vehicle on which launcher 12 is mounted are not in a level position.

We claim:

1. A quadrant elevation control device for a rocket launcher for controlling actuation of the rocket launcher to a predetermined launch angle relative to gravity, said quadrant elevation control device including means for selecting a predetermined angle to which the launcher is to be elevated and automatic means for interrupting an electrical circuit when said predetermined angle has been reached, said means for selecting a predetermined angle including a support structure on which a gunner's quadrant is mounted, said support structure being pivotably and slidably mounted relative to a housing structure to allow said support structure to be moved in and out of said housing structure and to be adjusted to a vertical position, said support structure having a first level vial mounted horizontally thereon, and said gunner's quadrant including a triangular shaped body and an adjustable pivotable arm pivotably connected to said triangular shaped body at a base corner thereof, said pivotable arm having an index pointer for adjusting said pivotable arm relative to an arcuate surface of said triangular shaped body, said arcuate surface having indica thereon for indicating the adjusted position of said pivotable arm, and said automatic means being mounted on said pivotable arm.

2. A quadrant elevation control device as set forth in claim 1, wherein said pivotable arm has a second level vial mounted thereon and said second level vial being mounted perpendicular to said first level vial.

3. A quadrant elevation control device as set forth in claim 2, wherein said automatic means for interrupting said electrical circuit includes a mercury switch mounted on said pivotable arm in parallel relation to said second level vial.

* * * * *